US006497128B1

(12) United States Patent
Canfield et al.

(10) Patent No.: US 6,497,128 B1
(45) Date of Patent: Dec. 24, 2002

(54) METHOD OF HYDROFORMING A FUEL RAIL FOR A VEHICULAR FUEL DELIVERY SYSTEM

(75) Inventors: James C. Canfield, Lake Orion, MI (US); Randall F. Alder, Fenton, MI (US); Gail M. Cunningham, Oxford, MI (US); David R. Fish, Waterford, MI (US); Harjinder Singh, Rochester Hills, MI (US)

(73) Assignee: Dana Corporation, Toledo, OH (US)

( * ) Notice: Subject to any disclaimer, the term of this patent is extended or adjusted under 35 U.S.C. 154(b) by 0 days.

(21) Appl. No.: 09/811,369

(22) Filed: Mar. 16, 2001

(51) Int. Cl.[7] ..... B21D 26/02
(52) U.S. Cl. ..... 72/61; 72/60; 29/421.1
(58) Field of Search ..... 72/58, 60, 61, 72/62; 29/421.1

(56) References Cited

U.S. PATENT DOCUMENTS

| | | | | | |
|---|---|---|---|---|---|
| 588,804 | A | | 8/1897 | Parish | |
| 2,138,199 | A | * | 11/1938 | Wendel | 72/58 |
| 2,238,037 | A | * | 4/1941 | Cornell, Jr. | 72/58 |
| 2,372,917 | A | * | 4/1945 | Tuttle | 29/421.1 |
| 2,892,254 | A | * | 6/1959 | Garvin | 72/58 |
| 3,681,960 | A | * | 8/1972 | Tadokoro | 72/61 |
| 4,051,704 | A | | 10/1977 | Kimura | |
| 4,312,542 | A | | 1/1982 | Schaefer | |
| 4,317,348 | A | * | 3/1982 | Halene et al. | 72/62 |
| 4,788,843 | A | | 12/1988 | Seaman et al. | |
| 4,928,509 | A | | 5/1990 | Nakamura | |
| 5,435,163 | A | | 7/1995 | Schäfer | |
| 5,845,621 | A | | 12/1998 | Robinson et al. | |
| 6,176,114 | B1 | * | 1/2001 | Gmurowski | 29/421.1 |
| 6,202,460 | B1 | * | 3/2001 | Gardon | 72/58 |

* cited by examiner

*Primary Examiner*—David Jones
(74) *Attorney, Agent, or Firm*—MacMillan, Sobanski & Todd, LLC

(57) ABSTRACT

A method of manufacturing a fuel rail for use in a fuel delivery system, such as for an engine in a vehicle, includes the initial hydroforming step to deform a central portion of a workpiece to have one or more outwardly extending node portions, followed by a subsequent hydroforming step to deform one or more end portions of the workpiece to have additional outwardly extending node portions. To do this, a pair of pressure feed pistons are disposed within the interior of the workpiece and have head portions that sealingly engage the inner surface of the workpiece so as to define a pressure chamber therein. Pressurized fluid is introduced into the pressure chamber so as to deform a portion thereof into conformance with the portion of the die cavity located within the pressure chamber. Then, the pressure feed pistons are moved to re-define the pressure chamber within the workpiece. Pressurized fluid is again introduced into the enlarged pressure chamber so as to deform other portions of the workpiece. The deformed workpiece is lastly subjected to conventional machining and/or metal working operations to provide a final fuel rail.

39 Claims, 5 Drawing Sheets

METHOD OF HYDROFORMING A FUEL RAIL FOR A VEHICULAR FUEL DELIVERY SYSTEM

BACKGROUND OF THE INVENTION

This invention relates in general to fuel rails for use in the fuel delivery systems of engines. In particular, this invention relates to an improved method of manufacturing such a fuel rail using hydroforming techniques.

Most engines, such as internal combustion engines and diesel engines that are used in vehicles and other devices, are equipped with a system for delivering fuel from a source or reservoir to a plurality of combustion chambers provided within the engine. In most modern vehicular engines, this fuel delivery system is a fuel injection system, wherein fuel is supplied under pressure to and selectively injected within each of the combustion chambers of the engine for subsequent combustion.

To accomplish this, a typical fuel injection system includes one or more fluid conduits (typically referred to as fuel rails) that transmit the fuel from the source to each of the combustion chambers of the engine. Each of the fuel rails is typically embodied as a hollow tube including an open end, a closed end, and a plurality of nodes located between the open and closed ends that extend outwardly from the hollow tube. The open end of the fuel rail is adapted to communicate with the source of the fuel. The hollow tube is shaped such that each of the nodes is positioned directly adjacent to an inlet of an associated one of the combustion chambers of the engine. Each of the nodes usually terminates in a hollow cylindrical cup portion that is adapted to receive a fuel injector therein. The fuel injectors are typically embodied as solenoid controlled valves that are selectively opened and closed by an electronic controller for the engine. When opened, the fuel injectors permit the pressurized fuel to flow from the fuel rail into the associated combustion chamber. When closed, the fuel injectors prevent fuel from flowing from the fuel rail into the associated combustion chamber. By carefully controlling the opening and closing of the fuel injectors, precisely determined amounts of the pressurized fuel can be injected from the fuel rail into each of the combustion chambers at precisely determined intervals.

Typically, the fuel rails are formed from a rigid material, such as plastic or metallic material. Plastic material fuel rails can be formed by injection molding and other well known processes. However, the majority of fuel rails are manufactured from metallic materials. Typically, a metallic fuel rail is manufactured by initially providing a tubular body portion that is bent or otherwise deformed to a desired shape. Then, a plurality of openings are formed through the hollow body portion at the locations where it is desired to provide the above-mentioned nodes. A hollow node portion (typically having the cup portion already formed therein) is next positioned adjacent to each of the openings and secured thereto, such as by brazing.

Although the above-described method for manufacturing the fuel rail has been performed successfully for many years, several drawbacks have been noted. One of such drawbacks is that it is relatively difficult to insure that the node portions of the fuel rail are precisely located relative to the body portion. This is because of several reasons. First, a relatively complicated fixture must be provided to precisely support the body portion and each of the node portions until they are secured together. Second, because the brazing process involves the application of relatively high temperature heat, dimensional stability in the precise positioning of the nodes is difficult to control. Thus, it would be desirable to provide an improved method of manufacturing a fuel rail that avoids these drawbacks.

SUMMARY OF THE INVENTION

This invention relates to an improved method of manufacturing a fuel rail for use in a fuel delivery system for an engine, such as is commonly used in a vehicle. A hydroforming apparatus includes first and second die sections having one or more retractable mandrels provided in respective bores. A workpiece is disposed within a die cavity defined by the first and second die sections, and end cylinders are moved into engagement with the opposite ends thereof. A pair of pressure feed pistons are disposed within the interior of the workpiece. The pressure feed pistons include respective head portions that sealingly engage the inner surface of the workpiece to define a pressure chamber within a central portion thereof. One of the mandrels is retracted position within its bore such that the inner surface thereof is disposed outwardly from the surface of the recess formed in the second die section. Either during or after such retracting movement, pressurized fluid from the source is introduced into the pressure chamber defined between the head portions of the pressure feed pistons. As a result, the portion of the workpiece that is exposed to such pressurized fluid is deformed outwardly into conformance with the portion of the die cavity located within the pressure chamber, including the portion of the bore that is exposed when the mandrel is moved to the retracted position. Accordingly, an outwardly extending node blank is formed on the workpiece. Thereafter, the pressure feed pistons are moved outwardly apart from one another to respective second positions that re-define the pressure chamber within the workpiece in a somewhat larger manner. Thus, the head portions of the pressure feed pistons are located outside of other bores formed through the second die section. The other mandrels are moved to their retracted positions within their respective bores, and pressurized fluid from the source is again introduced into the enlarged pressure chamber defined between the head portions of the pressure feed pistons. As a result, the other portions of the workpiece are deformed to form additional outwardly extending node blanks on the workpiece. To complete the manufacturing process, the deformed workpiece is removed from the hydroforming apparatus and subjected to conventional machining and/or metal working operations to provide a finished fuel rail.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
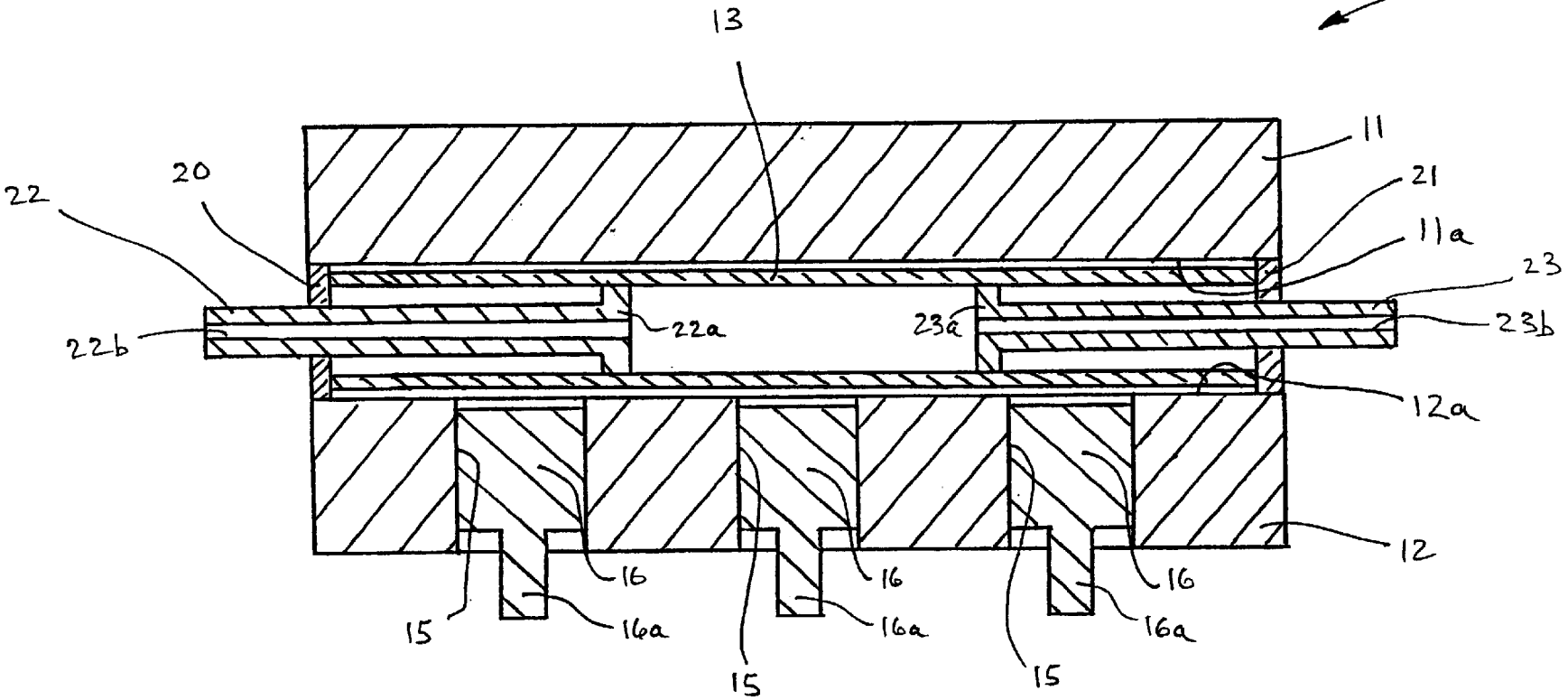
FIG. 1 is a schematic sectional elevational view of a portion of an apparatus for hydroforming a fuel rail in accordance with the method of this invention, wherein the apparatus is shown before the commencement of the hydroforming operation.

Referring now to the drawings, there is illustrated in FIG. 1 a portion of an apparatus, indicated generally at 10, for manufacturing a fuel rail using hydroforming techniques in accordance with the method of this invention. The basic structure and mode of operation of the hydroforming apparatus 10 are well known in the art, and only those portions thereof that are necessary for a complete understanding of the method of this invention are illustrated. The hydroforming apparatus 10 includes a frame (not shown) that supports first and second die sections 11 and 12 thereon for relative movement between opened and closed positions. The first and second die sections 11 and 12 have cooperating recesses 11*a* and 12*a* respectively formed therein that together define a die cavity. When moved to the opened position, the first and second die sections 11 and 12 are spaced apart from one another to allow a workpiece 13 to be inserted within or removed from the die cavity. When moved to the closed position, the first and second die sections 11 and 12 are disposed adjacent to one another so as to enclose the workpiece 13 within the die cavity. Although the die cavity is usually somewhat larger than the workpiece 13 to be hydroformed, movement of the two die sections 11 and 12 from the opened position to the closed position may, in some instances, cause some mechanical deformation of the workpiece 13.

To facilitate such relative movement, the first and second die sections 11 and 12 are usually arranged such that the first die section 11 is supported on a movable ram (not shown) of the apparatus 10, while the second die section 12 is supported on a stationary bed (not shown) of the apparatus 10. A mechanical or hydraulic actuator is provided for raising the ram and the first die section 11 upwardly to the opened position relative to the second die section 12, allowing a previously deformed workpiece 13 to be removed from and a new workpiece 13 to be inserted within the die cavity. The actuator also lowers the ram and the first die section 11 downwardly to the closed position relative to the second die section 12, allowing the hydroforming process to be performed. To maintain the first and second die sections 11 and 12 together during the hydroforming process, a clamping structure (not shown) may be provided. The clamping structure can engage the die sections 11 and 12 (or, alternatively, the ram and the bed upon which the die sections 11 and 12 are supported) to prevent them from moving relative to one another during the hydroforming process. Such relative movement would obviously be undesirable because the shape of the die cavity would become distorted, resulting in unacceptable variations in the final shape of the workpiece 13.

Figure 2:
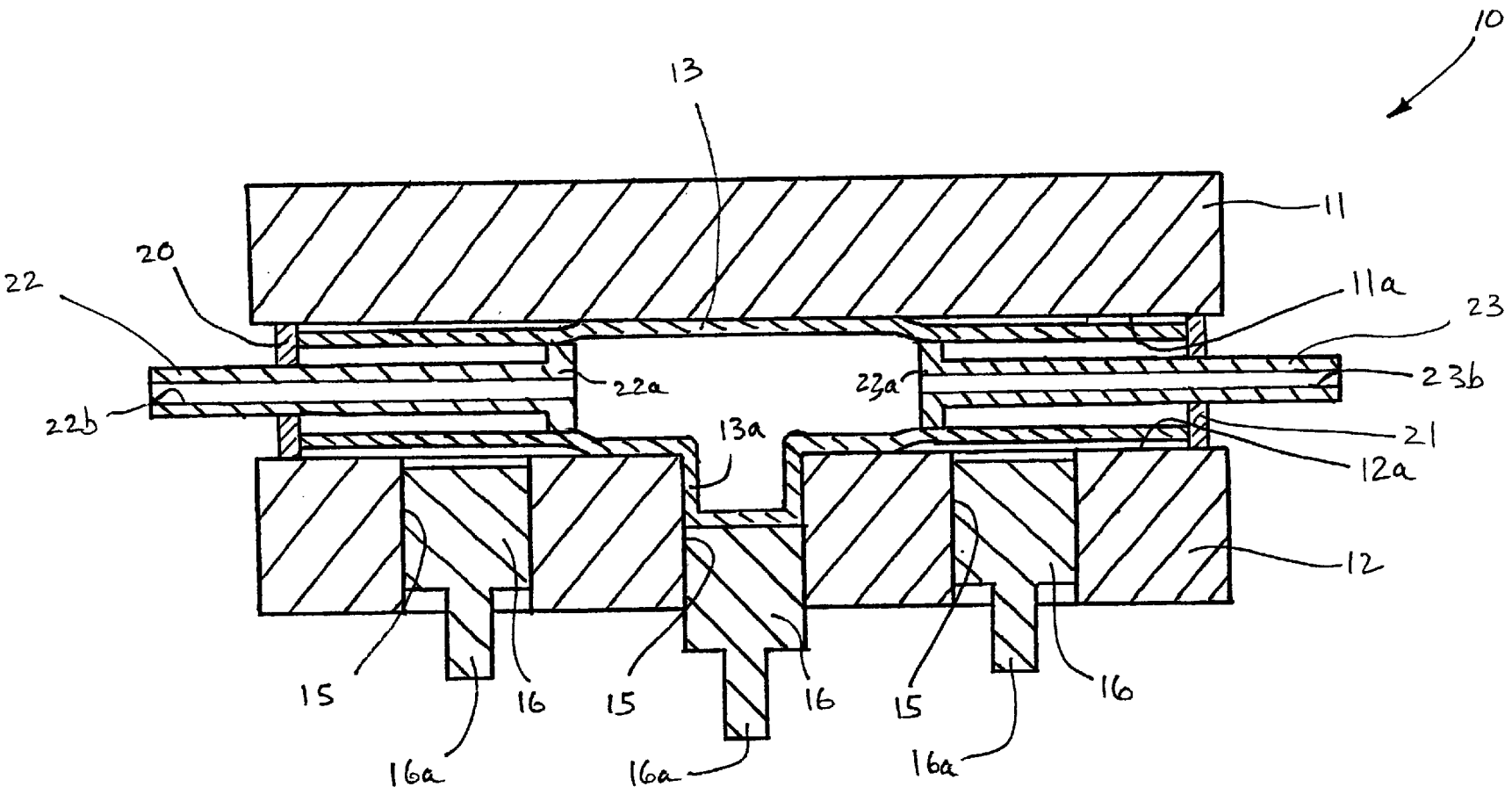
FIG. 2 is a schematic sectional elevational view similar to FIG. 1 showing the apparatus after the completion of a first step in the hydroforming operation.
Figure 3:
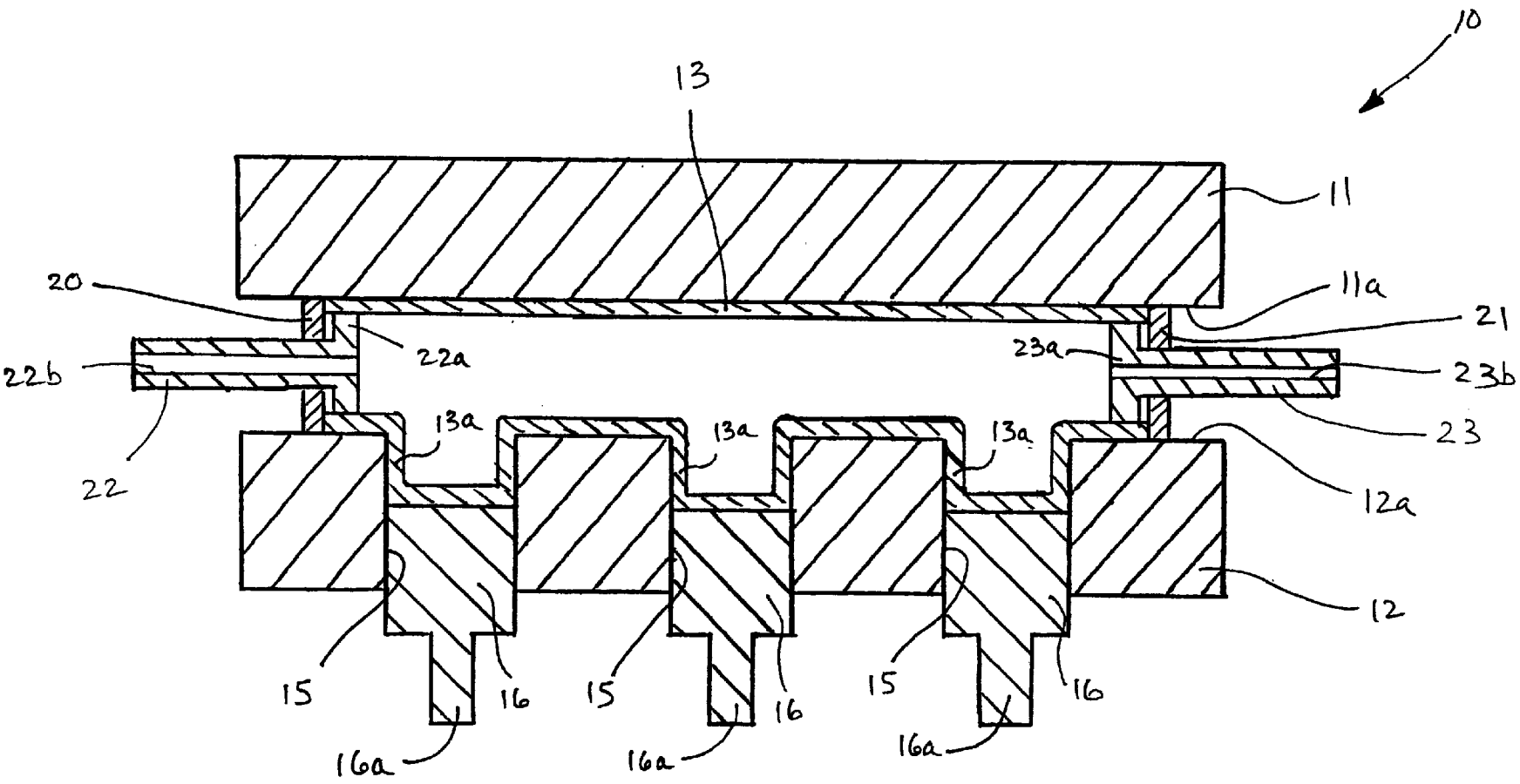
FIG. 3 is a schematic sectional elevational view similar to FIG. 2 showing the apparatus after the completion of a second step in the hydroforming operation.

At least one of the die sections (the second die section 12 in the illustrated embodiment) has a plurality of bores 15 formed therein that extend outwardly from the recess 12*a*. For the sake of explanation, let it be assumed that there are three pairs of such bores 15 formed in the second die section 12 (only three of the bores 15 are illustrated in FIGS. 1, 2, and 3). The illustrated bores 15 are arranged in a generally linear relationship such that a first one of the bores 15 is disposed between the other two of the bores 15. Notwithstanding this, however, this invention contemplates that any number of such bores 15 may be formed at any desired locations through either or both of the first and second die sections 11 and 12.

A mandrel 16 is disposed in each of the bores 15 for selective sliding movement relative to the second die section 12. Initially, each of the mandrels 16 is disposed within the bores 15 at an extended position (such as illustrated in FIG. 1), wherein the inner surface of the mandrel 16 is disposed generally flush with or adjacent to the surface of the recess 12*a* formed in the second die section 12. However, each of the mandrels 16 is connected by a linkage 16*a* or other means to an actuator (not shown) that can move the associated mandrel 16 to a retracted position (such as illustrated in FIGS. 2 and 3), wherein the inner surface of the mandrel 16 is disposed outwardly from the surface of the recess 12*a* formed in the second die section 12.

The hydroforming apparatus 10 further includes a pair of end cylinders, portions of which are shown at 20 and 21, that are positioned at opposite ends of the first and second die sections 11 and 12. The end cylinders 20 and 21 are conventional in the art and are adapted to engage the opposite ends of the workpiece 13, as shown in FIG. 1. As will be explained in greater detail below, the end cylinders 20 and 21 are adapted to selectively move inwardly toward one another so as to apply inwardly directed forces against the opposite ends of the workpiece 13 during the hydroforming operation.

Lastly, the hydroforming apparatus 10 includes a pair of pressure feed pistons 22 and 23 that extend within the interior of the workpiece 13, as also shown in FIG. 1. The pressure feed pistons 22 and 23 are movable relative to the die sections 11 and 12, the workpiece 13, and the end feed cylinders 20 and 21. The pressure feed pistons 22 and 23 have respective head portions 22*a* and 23*a* provided thereon that are adapted to sealingly engage the inner surface of the workpiece 13. The pressure feed pistons 22 and 23 further have respective passageways 22*b* and 23*b* formed therethrough that communicate with the interior of the hollow workpiece 13. As will be described in detail below, the passageways 22*b* and 23*b* can selectively provide fluid communication between a source of a pressurized fluid (not shown) and the interior of the hollow workpiece 13 to perform the hydroforming operation.

The operation of the hydroforming apparatus 10 will now be described. Initially, the apparatus 10 is operated to install a workpiece 13 therein prior to commencement of the hydroforming operation. To accomplish this, the apparatus 10 is first operated to move the first die section 11 to the opened position relative to the second die section 12. As discussed above, when the first and second die sections 11 and 12 are moved to the opened position, they are spaced apart from one another to allow the workpiece 13 to be inserted between the first and second die sections 11 and 12 and within the die cavity defined by the recesses 11*a* and 12*a*. At or about the same time, the apparatus 10 is operated to move all of the mandrels 15 to their extended positions, such that the inner surfaces thereof are disposed generally flush with or adjacent to the surface of the recess 12*a* formed in the second die section 12, as described above. Then, the apparatus 10 is operated to move the first die section 11 to the closed position relative to the second die section 12, thereby enclosing the workpiece 13 within the die cavity defined by the recesses 11*a* and 12*a*. The initial installation of the workpiece 13 is completed by moving the end cylinders 20 and 21 and the pressure feed pistons 22 and 23 to the positions illustrated in FIG. 1, wherein the end cylinders 20 and 21 engage the opposite ends of the workpiece 13, while the head portions 22*a* and 23*a* of the pressure feed pistons 22 and 23 are disposed within the interior of the workpiece 13.

The pressure feed pistons 22 and 23 are initially disposed within the interior of the workpiece 13. As mentioned above, the head portions 22*a* and 23*a* of the pressure feed pistons 22 and 23 sealingly engage the inner surface of the workpiece 13. Thus, the head portions 22*a* and 23*a* define a pressure chamber within a portion of the interior of the workpiece 13. Preferably, this pressure chamber is initially somewhat smaller than the interior of the workpiece 13 and may, as shown in FIG. 1, be limited to that portion of the interior of the workpiece 13 that extends only about the central bore 15 formed through the second die section 12. As also mentioned above, one or both of the passageways 22*b* and 23*b* formed through the pressure feed pistons 22 and 23 can selectively provide fluid communication between a source of a pressurized fluid (not shown) and the interior of the hollow workpiece 13 to perform the hydroforming operation. Typically, only one of such passageways 22*b* and 23*b* communicates with the source of pressurized fluid. The other of the passageways 22*b* and 23*b* is selectively vented through a valve (not shown) to a fluid reservoir for recycling the pressurized fluid when the hydroforming operation is completed.

FIG. 2 illustrates the apparatus 10 and the workpiece 13 after a first step in the hydroforming operation has been completed. To accomplish this first step, the innermost one of the mandrels 16 is moved to its retracted position within the bore 15 such that the inner surface is disposed outwardly from the surface of the recess 12*a* formed in the second die section 12. Either during or after such retracting movement, pressurized fluid from the source is introduced into the pressure chamber defined between the head portions 22*a* and 23*a* of the pressure feed pistons 22 and 23. As a result, the portion of the workpiece 13 that is exposed to such pressurized fluid is deformed outwardly into conformance with the portion of the die cavity located within the pressure chamber. This includes the portion of the central bore 15 that is exposed when the central mandrel 16 is moved to the retracted position. Accordingly, an outwardly extending node blank 13*a* is formed on the workpiece 13, as shown in FIG. 2.

As the workpiece 13 is deformed during the application of the pressurized fluid, the end cylinders 20 and 21 are moved inwardly toward one another. This process, known as end feeding, involves applying a mechanical force against one or both end portions of the workpiece 13 simultaneously as the interior portion of the workpiece 13 is being hydroformed. As a result, some of the material of the end portions of the workpiece 13 flows into the interior portion being hydroformed, particularly into the region where the outwardly extending node blank 13*a* is being hydroformed. This end feeding is performed to minimize undesirable reductions in the wall thickness of the deformed portions of the workpiece 13. The end feeding process is normally somewhat limited in its ability to cause the material of the end portions of the workpiece 13 to flow into the interior portion being deformed. By positioning the pressure feed pistons 22 and 23 as shown in FIGS. 1 and 2 during the hydroforming of the central node blank 13*a*, the effectiveness of the end feeding process is enhanced.

During the hydroforming process, portions of the outer workpiece 13 are urged into engagement with the surfaces of the recesses 11*a* and 12*a* of the first and second die sections 11 and 12. Because of the relatively high pressures exerted on the workpiece 13, a significant amount of friction can be developed between the outer surface of the workpiece 13 and the surfaces of the recesses 11*a* and 12*a* of the first and second die sections 11 and 12. Such frictional engagement is generally considered to be undesirable because it can inhibit the free movement of the material of the workpiece 13 during the end feeding operation. To address this, it is contemplated that a relatively small amount of fluid be provided between the outer surface of the workpiece 13 and the surfaces of the recesses 11*a* and 12*a* of the first and second die sections 11 and 12. Such fluid can be provided through appropriately sized passageways (not shown) formed through either or both of the first and second die sections 11 and 12 or in any other desired manner. This fluid functions as a lubricant to reduce the magnitude of friction generated during the hydroforming process. Preferably, the pressure of the fluid provided between the outer surface of the workpiece 13 and the surfaces of the recesses 11*a* and 12*a* of the first and second die sections 11 and 12 is relatively small in comparison with the pressure of the pressurized fluid supplied to the interior of the workpiece 13 to avoid affecting the hydroforming process.

After the completion of the first step in the hydroforming process, the pressure feed pistons 22 and 23 are moved outwardly apart from one another to respective second positions that re-define the pressure chamber within the workpiece 13 in a somewhat larger manner. As shown in FIG. 3, the head portions 22*a* and 23*a* of the pressure feed pistons 22 and 23 are moved so as to be located outside of the two outer bores 15 formed through the second die section 12. During this movement, the magnitude of the pressurized fluid within the workpiece 13 is reduced by virtue of the increased size of the pressure chamber. When the pressure feed pistons 22 and 23 have been re-positioned, a second step in the hydroforming process can be performed. To accomplish this, the other two mandrels 16 are moved to their retracted positions within their respective bores 15 such that the inner surfaces are disposed outwardly from the surface of the recess 12*a* formed in the second die section 12. Either during or after such movement, pressurized fluid from the source is again introduced into the enlarged pressure chamber defined between the head portions 22*a* and 23*a* of the pressure feed pistons 22 and 23. As a result, the portions of the workpiece 13 that are exposed to such pressurized fluid are deformed outwardly into conformance with the portions of the die cavity located within the pressure chamber. This includes the portions of the outer bores 15 that are exposed when the two mandrels 16 are moved to their retracted positions. Accordingly, an additional pair of outwardly extending node blanks 13*a* are formed on the workpiece 13, as shown in FIG. 3. As the workpiece 13 is deformed during this second step of the hydroforming process, the end cylinders 20 and 21 are again moved inwardly toward one another to cause some of the material of the end portions of the workpiece 13 to flow into the regions where the other outwardly extending node blanks 13*a* are being hydroformed.

Figure 4:
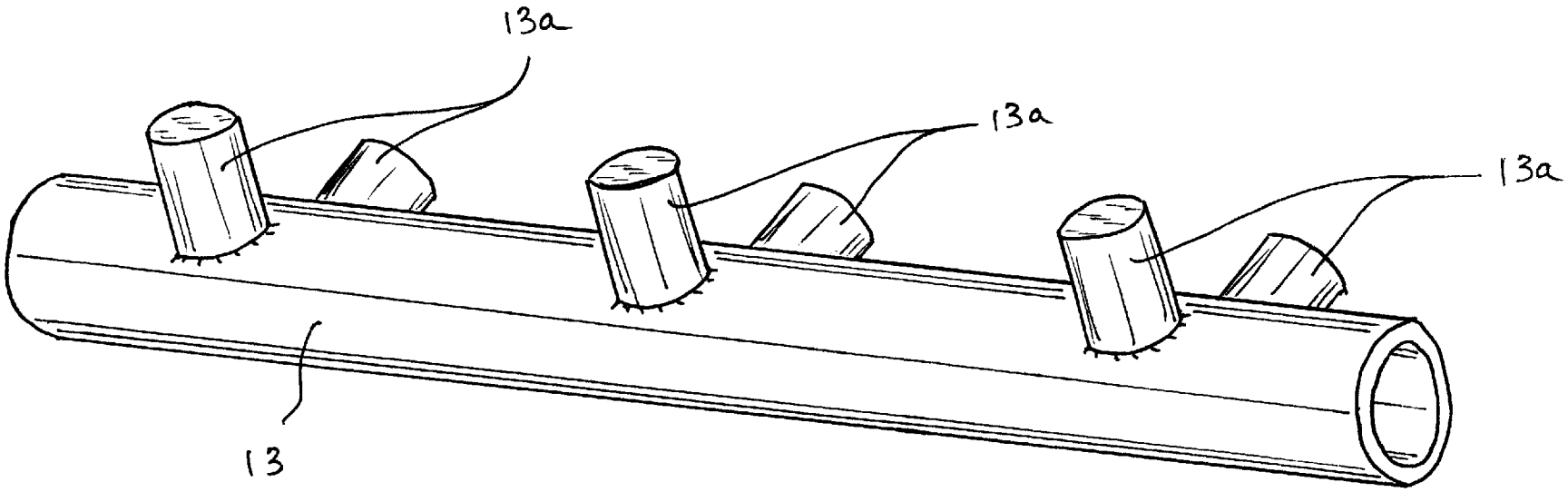
FIG. 4 is a perspective view of a blank for a fuel rail that has been manufactured in accordance with the method illustrated in FIGS. 1, 2, and 3.

At the conclusion of the second step of the hydroforming process, the source of fluid pressure is removed from communication with the interior of the workpiece 13, and the fluid contained within the workpiece 13 is drained therefrom, such as through either or both of the passageways 22*b* and 23*b* formed through the pressure feed pistons 22 and 23. The first die section 11 is then moved to the opened position relative to the second die section 12, allowing the deformed workpiece 13 to be removed from the hydroforming apparatus 10. The structure of the deformed workpiece 13 is shown in FIG. 4 and includes a hollow body portion having a plurality of hollow node blanks 13*a* extending outwardly therefrom.

Figure 5:
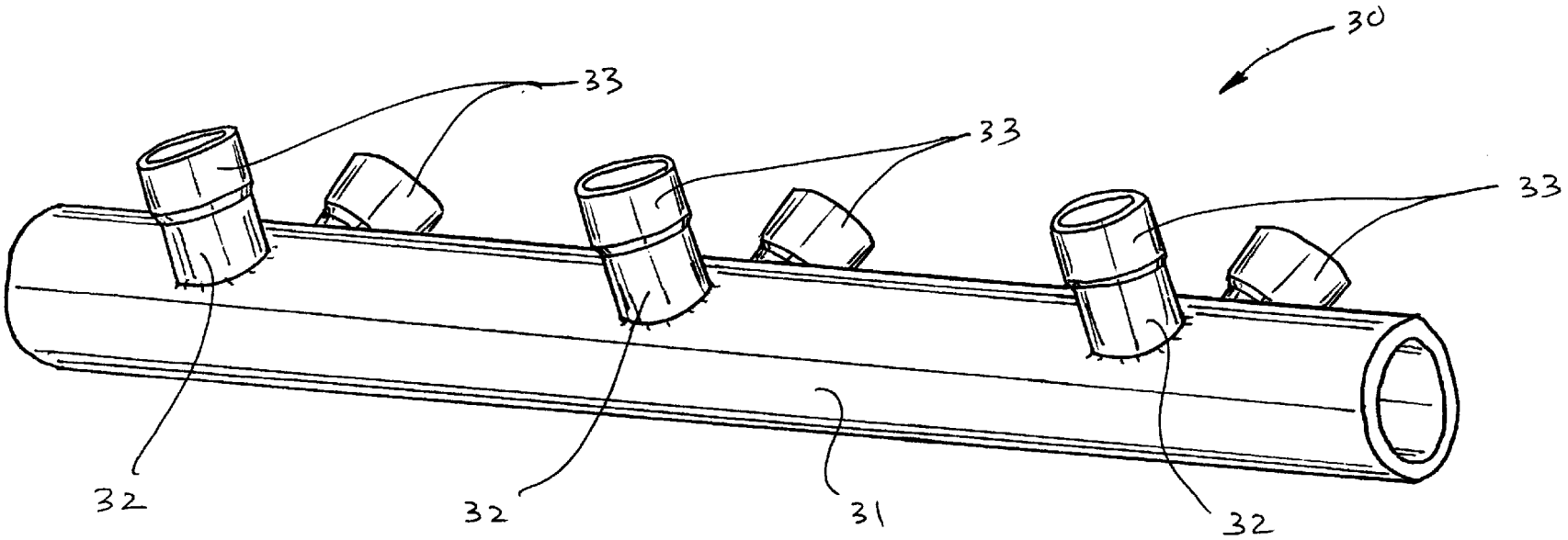
FIG. 5 is a perspective view of a completed fuel rail after final machining and metal working operations have been performed.

To complete the manufacturing process, the deformed workpiece 13 is subjected to conventional machining and/or metal working operations to provide a final fuel rail, indicated generally at 30 in FIG. 5. The final fuel rail 30 includes a hollow body portion 31 having a plurality of node portions 32 extending outwardly therefrom. Each of the node portions 32 terminates in an enlarged cup portion 33 that is adapted to receive a portion of a fuel injector (not shown) therein in a conventional manner, as described above. It will be appreciated that the method of this invention is not intended to be limited to the specific configuration of the illustrated fuel rail 30, but can be used to form a fuel rail having any desired configuration.

Referring back to FIG. 4, it can be seen that each of the illustrated node blanks 13*a* terminates in a closed end surface, and those closed end surfaces are removed during the final machining and/or metal working operations. However, it will be appreciate that the hydroforming apparatus 10 can be configured to remove such closed end surfaces of the node blanks 13*a* either during the hydroforming operation. For example, the inner surfaces of the mandrels 16 may be provided with respective annular punch embossments (not shown) that pierce through the material of the workpiece 13 as the node portions 13*a* are being deformed during the hydroforming process. Alternatively, the mandrels 16 may be provided with movable internal punches (not shown) that can be operated to punch through the closed end surfaces of the node portions 13*a* during or after the formation thereof.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A method of manufacturing a fuel rail for use in a fuel delivery system for an engine comprising the steps of:

(a) providing a hydroforming apparatus including a pair of die sections defining a die cavity;

(b) disposing a workpiece within the die cavity;

(c) hydroforming a first portion of the workpiece so as to conform with the shape of a first portion of the die cavity to form a first node blank;

(d) hydroforming a second portion of the workpiece so as to conform with the shape of a second portion of the die cavity to provide the fuel rail to form a second node blank;

(e) performing a machining or metal working operation on the first and second node blanks to form a hydroformed fuel rail having first and second node portions; and (f) installing the hydroformed fuel rail in a fuel delivery system, wherein fuel is supplied through the hydroformed fuel rail under pressure to and selectively injected within each of the combustion chambers of the engine for subsequent combustion.

2. The method defined in claim 1 wherein said step (c) is performed by inserting a pair of pressure feed pistons within the workpiece to define a pressure chamber within a first portion of the workpiece and providing pressurized fluid within the pressure chamber to hydroform the first portion of the workpiece.

3. The method defined in claim 1 wherein said step (c) includes the further step of applying a force to the end portions of the workpiece as it is being hydroformed such that some of the material of the end portions of the workpiece flows into the portion of the workpiece being hydroformed.

4. The method defined in claim 2 wherein said step (d) is performed by moving the pressure feed pistons within the workpiece to define a pressure chamber within a second portion of the workpiece and providing pressurized fluid within the pressure chamber to hydroform the second portion of the workpiece.

5. The method defined in claim 2 wherein said step (d) includes the further step of applying a force to the end portions of the workpiece as it is being hydroformed such that some of the material of the end portions of the workpiece flows into the portion of the workpiece being hydroformed.

6. The method defined in claim 1 wherein said step (c) is performed by providing fluid between the workpiece and the die cavity to reduce friction as the workpiece is being hydroformed.

7. The method defined in claim 1 wherein said step (a) is performed by providing a bore having a movable mandrel in at least one of the die sections.

8. The method defined in claim 7 wherein said step (c) is performed by moving the mandrel to a retracted position within the bore and hydroforming the workpiece to provide an outwardly extending node portion.

9. The method defined in claim 8 wherein said step (c) is performed by inserting a pair of pressure feed pistons within the workpiece to define a pressure chamber within a first portion of the workpiece including the bore and providing pressurized fluid within the pressure chamber to hydroform the first portion of the workpiece.

10. The method defined in claim 1 wherein said step (a) is performed by providing a plurality of bores having respective movable mandrels in at least one of the die sections.

11. The method defined in claim 10 wherein said step (c) is performed by inserting a pair of pressure feed pistons within the workpiece to define a pressure chamber within a first portion of the workpiece including one of the bores and providing pressurized fluid within the pressure chamber to hydroform the first portion of the workpiece.

12. The method defined in claim 11 wherein said step (d) is performed by moving the pressure feed pistons within the workpiece to define a pressure chamber within a second portion of the workpiece including more than one of the bores and providing pressurized fluid within the pressure chamber to hydroform the second portion of the workpiece.

13. The method defined in claim 11 wherein said step (d) is performed by moving the pressure feed pistons within the workpiece to define a pressure chamber within a second portion of the workpiece including all of the bores and providing pressurized fluid within the pressure chamber to hydroform the second portion of the workpiece.

14. A method of manufacturing an article comprising the steps of:

(a) providing a hydroforming apparatus including a pair of die sections defining a die cavity;

(b) disposing a workpiece within the die cavity;

(c) hydroforming a first portion of the workpiece so as to conform with the shape of a first portion of the die cavity while providing fluid between the workpiece and the die cavity to reduce friction as the workpiece is being hydroformed; and (d) hydroforming a second portion of the workpiece so as to conform with the shape of a second portion of the die cavity to manufacture the article.

15. The method defined in claim 14 wherein said step (c) is performed by inserting a pair of pressure feed pistons within the workpiece to define a pressure chamber within a first portion of the workpiece and providing pressurized fluid within the pressure chamber to hydroform the first portion of the workpiece.

16. The method defined in claim 14 wherein said step (c) includes the further step of applying a force to the end portions of the workpiece as it is being hydroformed such that some of the material of the end portions of the workpiece flows into the portion of the workpiece being hydroformed.

17. The method defined in claim 15 wherein said step (d) is performed by moving the pressure feed pistons within the workpiece to define a pressure chamber within a second portion of the workpiece and providing pressurized fluid within the pressure chamber to hydroform the second portion of the workpiece.

18. The method defined in claim 15 wherein said step (d) includes the further step of applying a force to the end portions of the workpiece as it is being hydroformed such that some of the material of the end portions of the workpiece flows into the portion of the workpiece being hydroformed.

19. The method defined in claim 14 including a further step (e) of performing a machining or metal working operation on the hydroformed article.

20. The method defined in claim 14 wherein said step (a) is performed by providing a bore having a movable mandrel in at least one of the die sections.

21. The method defined in claim 20 wherein said step (c) is performed by moving the mandrel to a retracted position within the bore and hydroforming the workpiece to provide an outwardly extending node portion.

22. The method defined in claim 21 wherein said step (c) is performed by inserting a pair of pressure feed pistons within the workpiece to define a pressure chamber within a first portion of the workpiece including the bore and providing pressurized fluid within the pressure chamber to hydroform the first portion of the workpiece.

23. The method defined in claim 14 wherein said step (a) is performed by providing a plurality of bores having respective movable mandrels in at least one of the die sections.

24. The method defined in claim 23 wherein said step (c) is performed by inserting a pair of pressure feed pistons within the workpiece to define a pressure chamber within a first portion of the workpiece including one of the bores and providing pressurized fluid within the pressure chamber to hydroform the first portion of the workpiece.

25. The method defined in claim 24 wherein said step (d) is performed by moving the pressure feed pistons within the workpiece to define a pressure chamber within a second portion of the workpiece including more than one of the bores and providing pressurized fluid within the pressure chamber to hydroform the second portion of the workpiece.

26. The method defined in claim 24 wherein said step (d) is performed by moving the pressure feed pistons within the workpiece to define a pressure chamber within a second portion of the workpiece including all of the bores and providing pressurized fluid within the pressure chamber to hydroform the second portion of the workpiece.

27. A method of manufacturing an article comprising the steps of:

(a) providing a hydroforming apparatus including a pair of die sections defining a die cavity, wherein at least one of the die sections includes a bore having a movable mandrel therein;

(b) disposing a workpiece within the die cavity;

(c) hydroforming a first portion of the workpiece so as to conform with the shape of a first portion of the die cavity; and (d) hydroforming a second portion of the workpiece so as to conform with the shape of a second portion of the die cavity to manufacture the article.

28. The method defined in claim 27 wherein said step (c) is performed by inserting a pair of pressure feed pistons within the workpiece to define a pressure chamber within a first portion of the workpiece and providing pressurized fluid within the pressure chamber to hydroform the first portion of the workpiece.

29. The method defined in claim 27 wherein said step (c) includes the further step of applying a force to the end portions of the workpiece as it is being hydroformed such that some of the material of the end portions of the workpiece flows into the portion of the workpiece being hydroformed.

30. The method defined in claim 28 wherein said step (d) is performed by moving the pressure feed pistons within the workpiece to define a pressure chamber within a second portion of the workpiece and providing pressurized fluid within the pressure chamber to hydroform the second portion of the workpiece.

31. The method defined in claim 28 wherein said step (d) includes the further step of applying a force to the end portions of the workpiece as it is being hydroformed such that some of the material of the end portions of the workpiece flows into the portion of the workpiece being hydroformed.

32. The method defined in claim 27 wherein said step (c) is performed by providing fluid between the workpiece and the die cavity to reduce friction as the workpiece is being hydroformed.

33. The method defined in claim 27 including a further step (e) of performing a machining or metal working operation on the hydroformed article.

34. The method defined in claim 27 wherein said step (c) is performed by moving the mandrel to a retracted position within the bore and hydroforming the workpiece to provide an outwardly extending node portion.

35. The method defined in claim 34 wherein said step (c) is performed by inserting a pair of pressure feed pistons within the workpiece to define a pressure chamber within a first portion of the workpiece including the bore and providing pressurized fluid within the pressure chamber to hydroform the first portion of the workpiece.

36. The method defined in claim 27 wherein said step (a) is performed by providing a plurality of bores having respective movable mandrels in at least one of the die sections.

37. The method defined in claim 36 wherein said step (c) is performed by inserting a pair of pressure feed pistons within the workpiece to define a pressure chamber within a first portion of the workpiece including one of the bores and providing pressurized fluid within the pressure chamber to hydroform the first portion of the workpiece.

38. The method defined in claim 37 wherein said step (d) is performed by moving the pressure feed pistons within the workpiece to define a pressure chamber within a second portion of the workpiece including more than one of the bores and providing pressurized fluid within the pressure chamber to hydroform the second portion of the workpiece.

39. The method defined in claim 37 wherein said step (d) is performed by moving the pressure feed pistons within the workpiece to define a pressure chamber within a second portion of the workpiece including all of the bores and providing pressurized fluid within the pressure chamber to hydroform the second portion of the workpiece.

* * * * *